US008474098B1

(12) United States Patent
Yang

(10) Patent No.: US 8,474,098 B1
(45) Date of Patent: Jul. 2, 2013

(54) ADJUSTABLE PULLING ROD SET

(75) Inventor: Cheng-Chiang Yang, Taichung (TW)

(73) Assignee: Great Taiwan Material Handling Co., Taichung (TW)

( * ) Notice: Subject to any disclaimer, the term of this patent is extended or adjusted under 35 U.S.C. 154(b) by 0 days.

(21) Appl. No.: 13/481,951

(22) Filed: May 28, 2012

(51) Int. Cl.
*A45C 7/00* (2006.01)

(52) U.S. Cl.
USPC ..... 16/113.1

(58) Field of Classification Search
USPC ..... 16/113.1, 405, 429; 190/18 A, 115; 280/47.371, 47.17, 655, 655.1; 403/109.3, 403/109.6, 109.7, 109.2, 109.5
See application file for complete search history.

(56) References Cited

U.S. PATENT DOCUMENTS 5,526,908 A * 6/1996 Wang ..... 190/115
5,642,552 A * 7/1997 Wang ..... 16/113.1
5,692,266 A * 12/1997 Tsai ..... 16/113.1
5,816,374 A * 10/1998 Hsien ..... 190/115
5,884,362 A * 3/1999 Tsai ..... 16/113.1
6,047,442 A * 4/2000 Workman ..... 16/113.1
6,247,203 B1 * 6/2001 Kuo ..... 16/113.1
6,305,514 B1 * 10/2001 Lin et al. ..... 190/115
6,575,274 B1 * 6/2003 Huang ..... 190/115
2002/0070087 A1 * 6/2002 Lee ..... 190/115
2005/0183914 A1 * 8/2005 Lin ..... 190/115

* cited by examiner

*Primary Examiner* — Chuck Y. Mah

(57) ABSTRACT

An adjustable pulling rod set includes a switch, a base and a cover. The switch is on the base. The switch includes an operating component, two positioning rods and a spring. A rail and two gaps are opened on the operating component. The two gaps communicate with the rail. The two positioning rods pass through the rail respectively. Two abutting nodes are defined on one end of the two positioning rods respectively. Each abutting node has two wings. The two wings abut against the inner side of the two gaps. Both ends of the spring abut against the two abutting nodes of the two positioning rods respectively. When the button is pressed, the two wings are forced by the two slice bodies along the two gaps and the two positioning rods compress the spring. Thus, the height of a pulling rod will be adjustable.

5 Claims, 4 Drawing Sheets

ADJUSTABLE PULLING ROD SET

BACKGROUND OF THE INVENTION

1. Field of the Invention

The present invention relates to a handlebar for loaders, and more particularly to an adjustable pulling rod set for loaders.

2. Description of Related Art

Generally, a wheel set is mounted on the bottom of loaders, like carts, school bags, baggage in order to reduce the effort and time consumed in transporting the loads or carrying the books, packages. For example, during the delivering process, the post officers can stack more packages on the cart for time saving. In addition, the post officers can transport the heavy packages easily via the wheel set mounted on those loaders.

Conventionally, a loader has a handlebar. Thus, a user can transport the cargos and control the direction of the loader more easily. Otherwise, the user cannot change the direction of the loader easily.

The conventional handlebar has a cap which has a recess and a passing hole defined thereon. A pushing component is assembled on the recess. The pushing component has a plurality of protrusions exposed on the passing hole. A first T-shaped driving component is received in the passing hole. The first T-shaped driving component has a first block defined thereon. A second T-shaped driving component is received in the passing hole and communicated with the first T-shaped driving component. The second T-shaped driving component has a second block and a plurality of grooves defined thereon. the protrusions of the pushing component engages with the grooves respectively, the sliding of the protrusions along the groove correspondingly drives the second T-shaped driving component to move along the passing hole, and drives the first T-shaped driving component to move, too. In this way, the conventional handlebar can change its length for a tall person or a short person to grip.

However, the complexity of the conventional handlebar arise the cost of manufacturing and the difficulties of assembling/repairing.

The present invention has arisen to mitigate and/or obviate the disadvantages of the conventional pulling rod set.

SUMMARY OF THE INVENTION

The main objective of the present invention is to provide an improved adjustable pulling rod set for loaders.

To achieve the objective, an adjustable pulling rod set comprises two pulling rods parallel to each other, a switch, a base and a cover, the two pulling rods passing through the adjustable pulling rod set, the switch mounted on the base, the switch comprising an operating component, two positioning rods and a spring, a button protruded from one side of the operating component, another side of the operating component having two slice bodies extended therefrom, the two slice bodies parallel to each other, a rail formed between the two slice bodies, two gaps respectively opened on the two slice bodies, the width of each gap gradually increased from the button to the bottom of each gap, two feet inwardly protruded from the bottom of each slice body and faced to each other; two abutting nodes defined on one end of the two positioning rods respectively, the two abutting nodes of the two positioning rods sliding along the rail respectively and assembled into the rail, each abutting node having two wings defined thereon, the two wings near the inner side of the two gaps, the two feet avoiding the two wings coming off the rail, two fixing parts defined on the two positioning rods respectively, each fixing part opposite to the abutting node and placed into the pulling rod, both ends of the spring abutting against the two abutting nodes of the two positioning rods respectively, the spring further abutting and fixing the two fixing parts of the two positioning rods respectively into the pulling rod, the cover covering the switch and mounting on the base, a button hole opened on the cover corresponding to the button, the button protruding and passing through the button hole; wherein when the button is pressed, the two wings are forced by the two slice bodies along the two gaps and the two wings move from the feet to the button and come closer to each other; the two positioning rods simultaneously compress the spring and the fixing parts of the two positioning rods are detaching from the pulling rod; when the button is released, the two fixing parts of the two positioning rods can be placed and fixed into the pulling rod again by the elastic force generated from the spring.

The middle part of the base has a cave defined thereon. The spring is placed into the cave and both ends of the spring abut against the two positioning rods respectively. In this arrangement, the position of the spring is fixed by the cave and will not come off the base under compressing/elongating progress.

Two positioning grooves are defined on the base, The two positioning grooves are adjacent to both ends of the cave respectively; the ends of the two slice bodies of the operating component are placed into the two positioning grooves correspondingly. Thus, the operating component can only move up and down respect to the two positioning grooves.

Two abutting grooves are defined on the two abutting nodes of the two positioning rods respectively. The spring is placed into the two abutting grooves. Two protrusions are defined on the two abutting nodes of the two positioning rods respectively. The two protrusions further pass through the spring. Therefore, the two positioning rods compress the spring.

Further benefits and advantages of the present invention will become apparent after a careful reading of the detailed description with appropriate reference to the accompanying drawings.

DETAILED DESCRIPTION OF THE INVENTION

Figure 1:
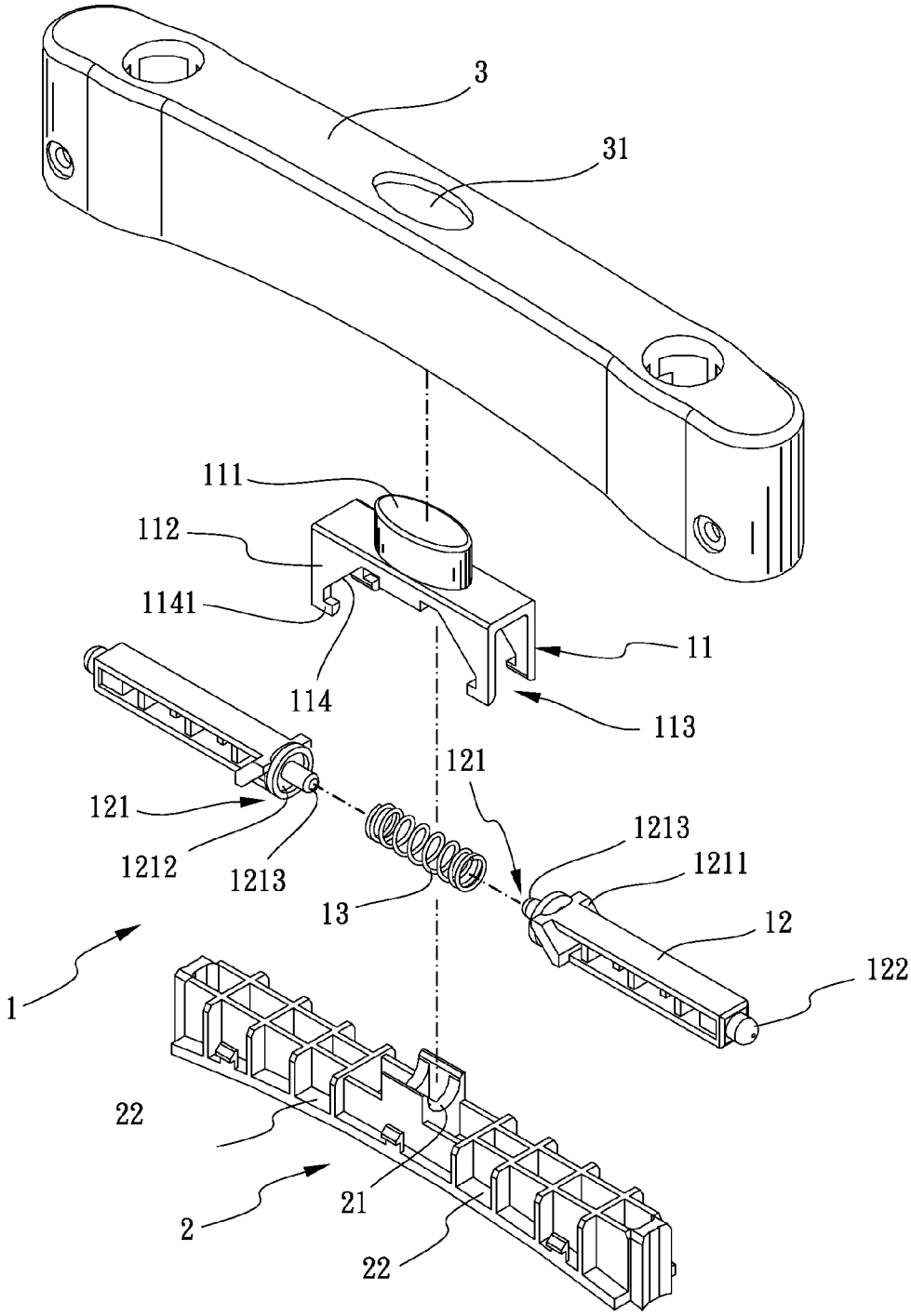
FIG. 1 is an exploded view of an adjustable pulling rod set.
Figure 2:
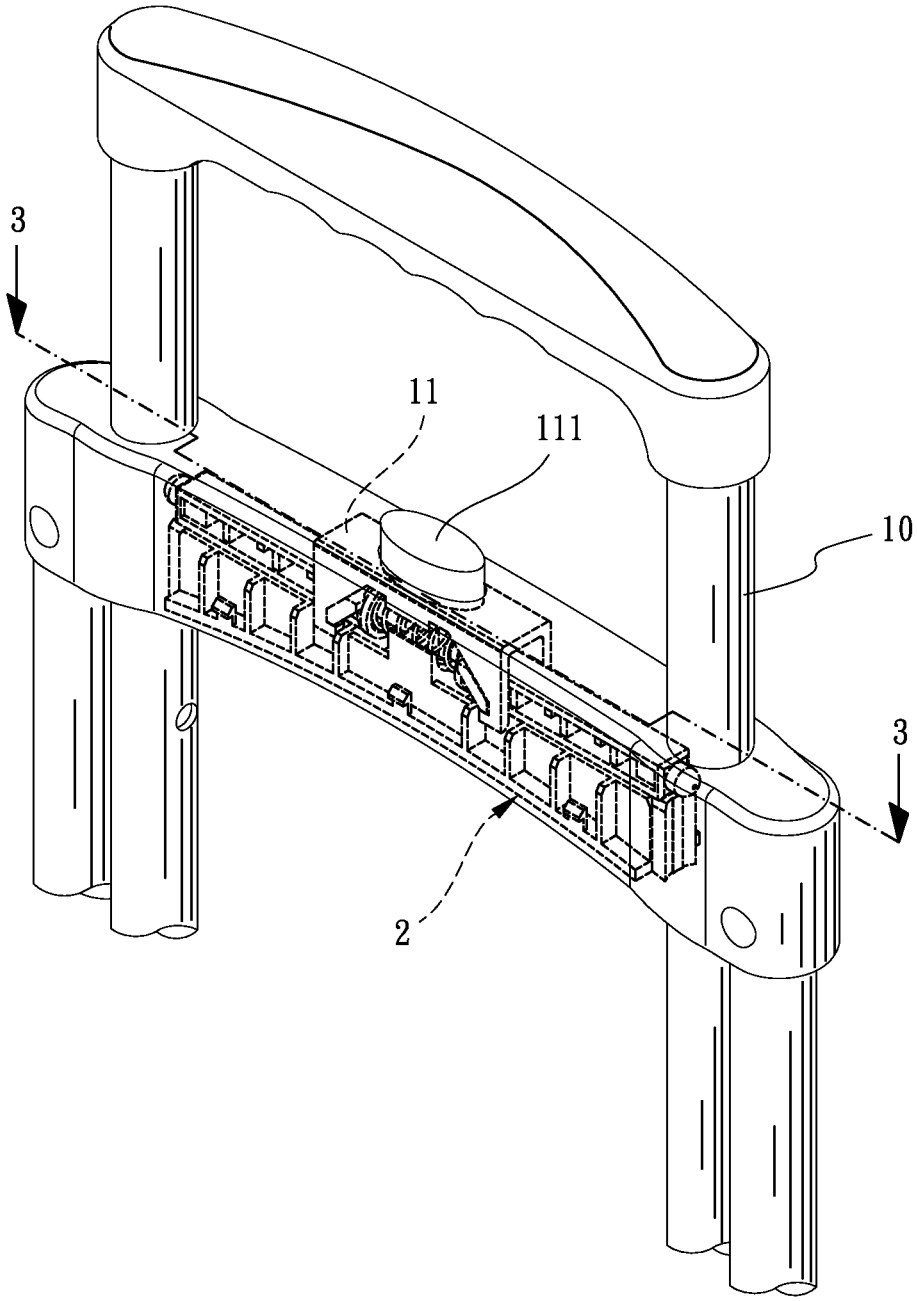
FIG. 2 is an assembled view of the adjustable pulling rod set.
Figure 3:
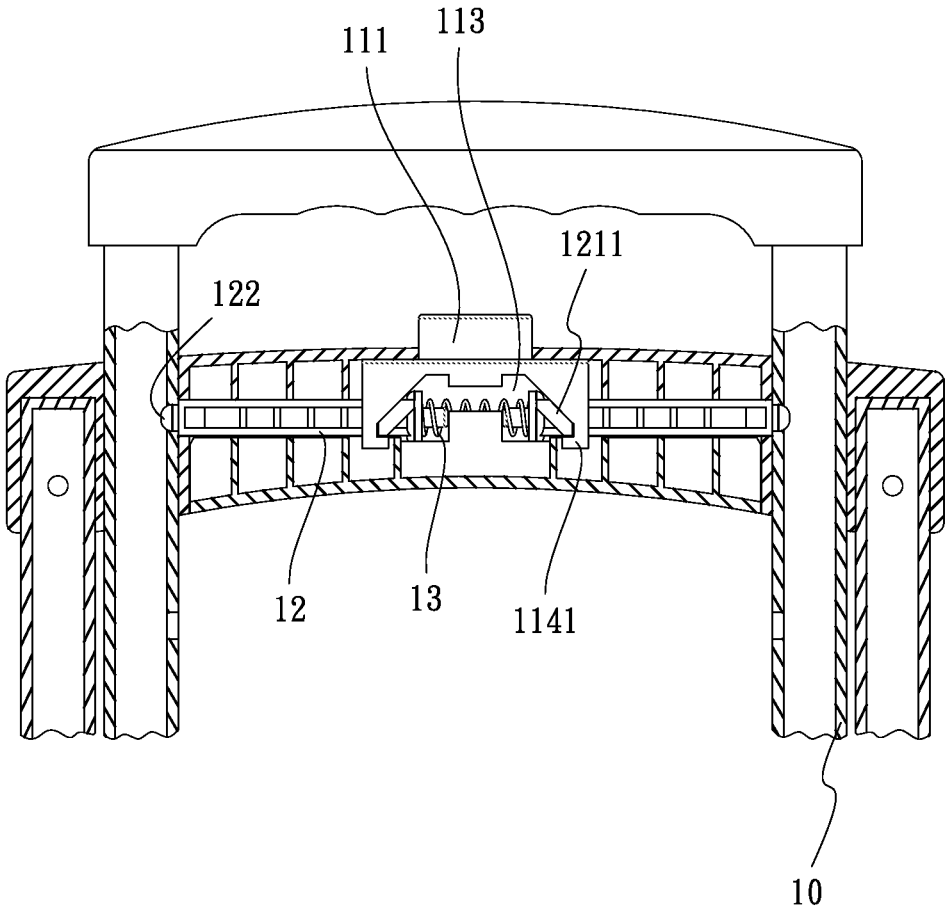
FIG. 3 is a cross-sectional view of the adjustable pulling rod set along line 33 in FIG. 2.

Referring to the drawings and initially to FIGS. 1-3, an adjustable pulling rod set in accordance with the present invention comprises two pulling rods 10 which are parallel to each other, a switch 1, a base 2 and a cover 3. The two pulling rods 10 pass through the adjustable pulling rod set.

The switch 1 is mounted on the base 2. The switch 1 includes an operating component 11, two positioning rods 12 and a spring 13. A button 111 is protruded from one side of the operating component 11 and another side of the operating component 11 has two slice bodies 112 extended therefrom. The two slice bodies 112 are parallel to each other. A rail 113 is formed between the two slice bodies 112. Two gaps 114 are respectively opened on the two slice bodies 112. The width of each gap 114 is gradually increased from the button 111 to the bottom of each gap 114 (The top of the gap 114 is narrower and the bottom of the gap 114 is broader as illustrated in FIG. 1). Two feet 1141 are inwardly protruded from the bottom of each slice body 112 and faced to each other.

Two abutting nodes 121 are defined on one end of the two positioning rods 12 respectively. The two abutting nodes 121 of the two positioning rods 12 are sliding along the rail 113 respectively and assembled into the rail 113. Each abutting node 121 has two wings 1211 defined thereon. The two wings 1211 are near the inner side of the two gaps 114. The two feet 1141 avoid the two wings 1211 coming off the rail 113. Two fixing parts 122 are defined on the two positioning rods 12 respectively. The fixing part 122 is opposite to the abutting node 121 and is placed into the pulling rod 10. Both ends of the spring 13 abut against the two abutting nodes 121 of the two positioning rods 12 respectively. The spring 13 further abuts and fixes the two fixing parts 122 of the two positioning rods 12 respectively into the pulling rod 10 (In this embodiment, the spring 13 is compressive).

The cover 3 covers the switch 1 and mounts on the base 2 (In this embodiment, the cover 3 is engaged with the base 2). A button hole 31 is opened on the cover 3 corresponding to the button 111. The button 111 protrudes and passes through the button hole 31.

Referring to FIG. 3, when the button 111 is not pressed, the two positioning rods 12 are located at the lower part of the rail 113, and the two positioning rods 12 are located corresponding to the two gaps 114. Because the spring 13 abuts the two positioning rods 12, the location of the two positioning rods 12 is fixed. The two feet 1141 constraint the two wings 1211 and avoid the two positioning rods 12 coming off the rail 113. The two fixing parts 122 of the two positioning rods 12 are fixed and placed into the pulling rod 10. Thus, the pulling rod 10 can be fixed at an appropriate height for a user to pull/push the loads.

Figure 4:
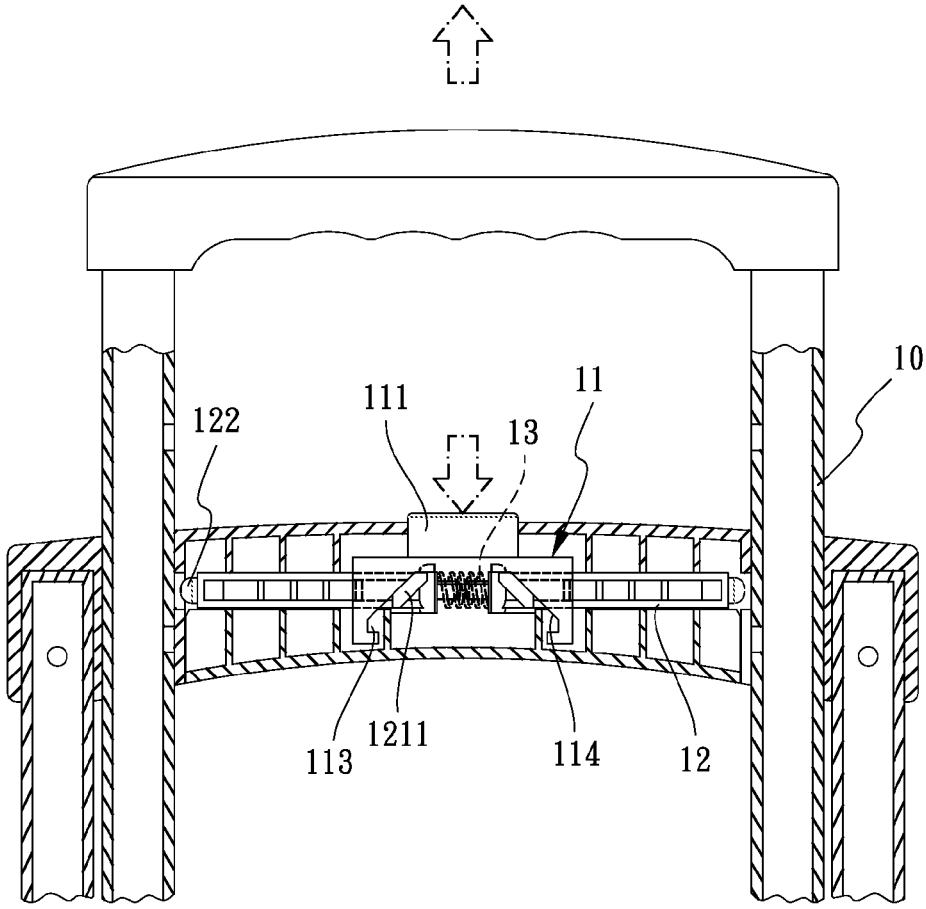
FIG. 4 is a cross-sectional view of the adjustable pulling rod set along line 33 in FIG. 2 for showing a user to adjust the height of the pulling rod.

Referring to FIG. 4, when the button 111 is pressed, the two wings 1211 are forced by the two slice bodies 112 along the two gaps 114. The two wings 1211 simultaneously move from the feet 1141 to the button 111 and come closer to each other. Under this situation, the two positioning rods 12 compress the spring 13, and the fixing parts 122 of the two positioning rods 12 are detaching from the pulling rod 10. As a result, the height of the pulling rod 10 is adjustable by elongating/shortening the pulling rod 10. When the button 111 is released, the two fixing parts 122 of the two positioning rods 12 can be placed and fixed into the pulling rod 10 again by the elastic force generated from the spring 13.

Referring to the FIGS. 1-3, the present invention further includes the following features:

1. The middle part of the base 2 has a cave 21 defined thereon. The spring 13 is placed into the cave 21. Both ends of the spring 13 abut against the two positioning rods 12 respectively. Two abutting grooves 1212 are defined on the two abutting nodes 121 of the two positioning rods 12 respectively. The spring 13 is placed into the two abutting grooves 1212 (In this embodiment, the shape of the abutting grooves 1212 is round). Two protrusions 1213 are defined on the two abutting nodes 121 of the two positioning rods 12 respectively (In this embodiment, the two protrusions 1213 are located at the center of the two abutting grooves 1212 respectively). The two protrusions 1213 further pass through the spring 13. The two positioning rods 12 compress the spring 13 and the compressed spring 13 is stably received between the two abutting grooves 1212 and the two protrusions 1213. In this arrangement, the position of the spring 13 is fixed by the cave 21 and will not come off the base 2 under compressing/elongating progress.

2. Two positioning grooves 22 are defined on the base 2. The two positioning grooves 22 are adjacent to both ends of the cave 21 respectively. The ends of the two slice bodies 112 of the operating component 11 are placed into the two positioning grooves 22 correspondingly, so that the operating component 11 can only move up and down respect to the two positioning grooves 22 and cannot move left and right respect to the two positioning grooves 22.

Although the invention has been explained in relation to its preferred embodiment, it is to be understood that many other possible modifications and variations can be made without departing from the spirit and scope of the invention as hereinafter claimed.

What is claimed is:

1. An adjustable pulling rod set comprising:

a pulling handle, two pulling rods extending from the handle and being parallel to each other, a switch, a base and a cover, the two pulling rods slidably passing through two respective openings formed in the cover;

the cover mounted to the base and defining a space therebetween;

the switch mounted on the base within said space, the switch comprising:

an operating component, two positioning rods and a spring, said operating component having a button protruding from an upper side of the operating component, two slice bodies extending downwardly from a bottom side of the operating component and being parallel to each other, thereby defining a rail between the two slice bodies, each of said slice bodies having a downward-opening gap, the width of each gap gradually increased from the top to the bottom of each gap, thereby defining two opposite diverging cam surfaces on each slice body, two feet inwardly protruding from the bottom of each slice body and facing each other;

each of said positioning rods having an abutting nodes defined on one end thereof, the two abutting nodes of the two positioning rods being slidable along the rail respectively and assembled into the rail, each abutting node having two wings defining two oblique surfaces to slidably engage the respective cam surfaces from said two slice bodies, the two feet avoiding the two wings coming off the rail, each said positioning rod further having a fixing part protruding from an opposite end, adapted to selectively engage one of a plurality of positioning holes formed in the respective pulling rod, said spring having two opposite ends, both ends of the spring abutting against the two abutting nodes of the two positioning rods respectively and biasing the positioning rods away from each other to retain the fixing parts in engagement with the respective positioning holes; and the cover having a button hole opened on the cover corresponding to the button, the button protruding and passing through the button hole;

wherein when the button is pressed downward, the two wings of each positioning rod are forced by the cam surfaces such that the two positioning rods simultaneously compress the spring and the fixing parts of the two positioning rods are detaching from the pulling rods; when the button is released, the two fixing parts of the two positioning rods can be placed and fixed into the pulling rod again by the elastic force generated from the spring.

2. The adjustable pulling rod set as claimed in claim 1, wherein a middle part of the base has a cave defined thereon; the spring is placed into the cave and both ends of the spring abut against the two positioning rods respectively.

3. The adjustable pulling rod set as claimed in claim 2, wherein two positioning grooves are defined on the base, the two positioning grooves are adjacent to both ends of the cave respectively; the bottom ends of the two slice bodies of the operating component are placed into the two positioning grooves correspondingly.

4. The adjustable pulling rod set as claimed in claim 1, wherein an abutting grooves is defined on each of the two abutting nodes of the two positioning rods; the spring ends are placed into the two abutting grooves of the abutting nodes respectively.

5. The adjustable pulling rod set as claimed in claim 1, wherein a protrusion is defined on each of the two abutting nodes of the two positioning rods; the two protrusions further pass through the spring.

* * * * *